US008967910B2

(12) United States Patent
Hansen et al.

(10) Patent No.: US 8,967,910 B2
(45) Date of Patent: Mar. 3, 2015

(54) ECCENTRIC WEIGHT SHAFT FOR VIBRATORY COMPACTOR

(71) Applicant: Caterpillar Paving Products Inc., Brooklyn Park, MN (US)

(72) Inventors: Eric A Hansen, Big Lake, MN (US); Matthew D. Chisholm, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/160,632

(22) Filed: Jan. 22, 2014

(65) Prior Publication Data

US 2014/0133909 A1 May 15, 2014

(51) Int. Cl.
*E01C 19/28* (2006.01)
*B06B 1/00* (2006.01)

(52) U.S. Cl.
CPC ..... *E01C 19/286* (2013.01); *B06B 1/00* (2013.01)
USPC ..... 404/117; 404/113

(58) Field of Classification Search
CPC ..... E01C 19/28; E01C 19/286; B06B 1/00
USPC ..... 404/117, 113
See application file for complete search history.

(56) References Cited

U.S. PATENT DOCUMENTS 4,260,280 A * 4/1981 Hirn et al. ..... 404/122
4,619,552 A * 10/1986 Sadahiro ..... 404/117
4,632,599 A * 12/1986 Sadahiro ..... 404/124
5,934,825 A * 8/1999 Waldenberger ..... 404/133.1
8,206,061 B1 6/2012 Hansen et al.

* cited by examiner

*Primary Examiner* — Raymond W Addie
(74) *Attorney, Agent, or Firm* — Andrew A. Phillips

(57) ABSTRACT

A vibratory compactor includes a roller and an eccentric shaft. The roller is rotatably mounted on a main frame and may include a first vertical support and a second vertical support. The eccentric shaft is rotatably connected between the first vertical support and the second vertical support in the roller. The eccentric shaft includes a first end, a second end, a first eccentric weight, a second eccentric weight, and a center portion, casted as a single piece. The first eccentric weight is proximal to the first end and the second eccentric weight is proximal to the second end. The center portion may be disposed between the first eccentric weight and the second eccentric weight. The center portion may include at least one cavity on a surface of the center portion. The at least one cavity is elongated between the first eccentric weight and the second eccentric weight.

1 Claim, 3 Drawing Sheets

ECCENTRIC WEIGHT SHAFT FOR VIBRATORY COMPACTOR

TECHNICAL FIELD

The present disclosure relates to vibratory compactor machines, more particularly to an eccentric weight shaft for vibratory compactor.

BACKGROUND

Compactors are extensively used in the road construction industry for construction and repair of the road surfaces. There are a variety of compactors such as soil compactors, landfill compactors, vibratory compactors, tandem vibratory rollers, pneumatic rollers, etc. The present disclosure is directed to vibratory compactors. Vibratory compactors can be used to compact sand, gravel, or crushed aggregate for foundations, footings, or driveways; base preparation for concrete slabs, asphalt parking lots, etc. Vibratory compactors can also be used to compact the hot mix asphalt or the cold mix asphalt for a purpose of patching and repairing of roads, highways, sidewalks, parking lots, and the like.

A typical vibratory compactor includes at least one roller. The roller serves the purpose of compacting a surface. The roller is mounted on a main frame and is configured to compact the surface beneath the vibratory compactor. The roller includes a vibratory mechanism. The vibratory mechanism includes an eccentric shaft which is accelerated by a first motor, and imparts vibrations to the roller. A second motor is provided which rotates the roller, and hence the vibratory compactor moves forward/backward. Traditionally, the eccentric shaft has one or more weights press-mounted or welded on the eccentric shaft to achieve a desired eccentricity, thereby increasing manufacturing costs. The existing eccentric shaft is heavy in weight and more prone to bending failures. Also, the existing eccentric shaft has a high start-up torque. The high start-up torque may lead to high operating and wear and tear of the first motor. Hence, there is a need to reduce the weight, the manufacturing cost, and the bending failures. Also, there is a need to reduce the start-up torque.

SUMMARY OF THE DISCLOSURE

According to an embodiment of the present disclosure a vibratory compactor is provided. The vibratory compactor includes a roller configured to compact a surface. The roller is rotatably mounted on a main frame and may include a first vertical support and a second vertical support. The vibratory compactor may also include an eccentric shaft. The eccentric shaft is rotatably connected between the first vertical support and the second vertical support in the roller. In accordance with an embodiment of the present disclosure, the eccentric shaft includes a first end, a second end, a first eccentric weight, a second eccentric weight, and a center portion. The first eccentric weight is proximal to the first end and the second eccentric weight is proximal to the second end. The first eccentric weight is in a shape of a segment around the eccentric shaft subtending an arc of a predefined angle and the second eccentric weight is in the shape of the segment around the eccentric shaft subtending the arc of the predefined angle. The center portion may be disposed between the first eccentric weight and the second eccentric weight. The center portion may include at least one cavity on a surface of the center portion. The at least one cavity is elongated between the first eccentric weight and the second eccentric weight.

DETAILED DESCRIPTION

Figure 1:
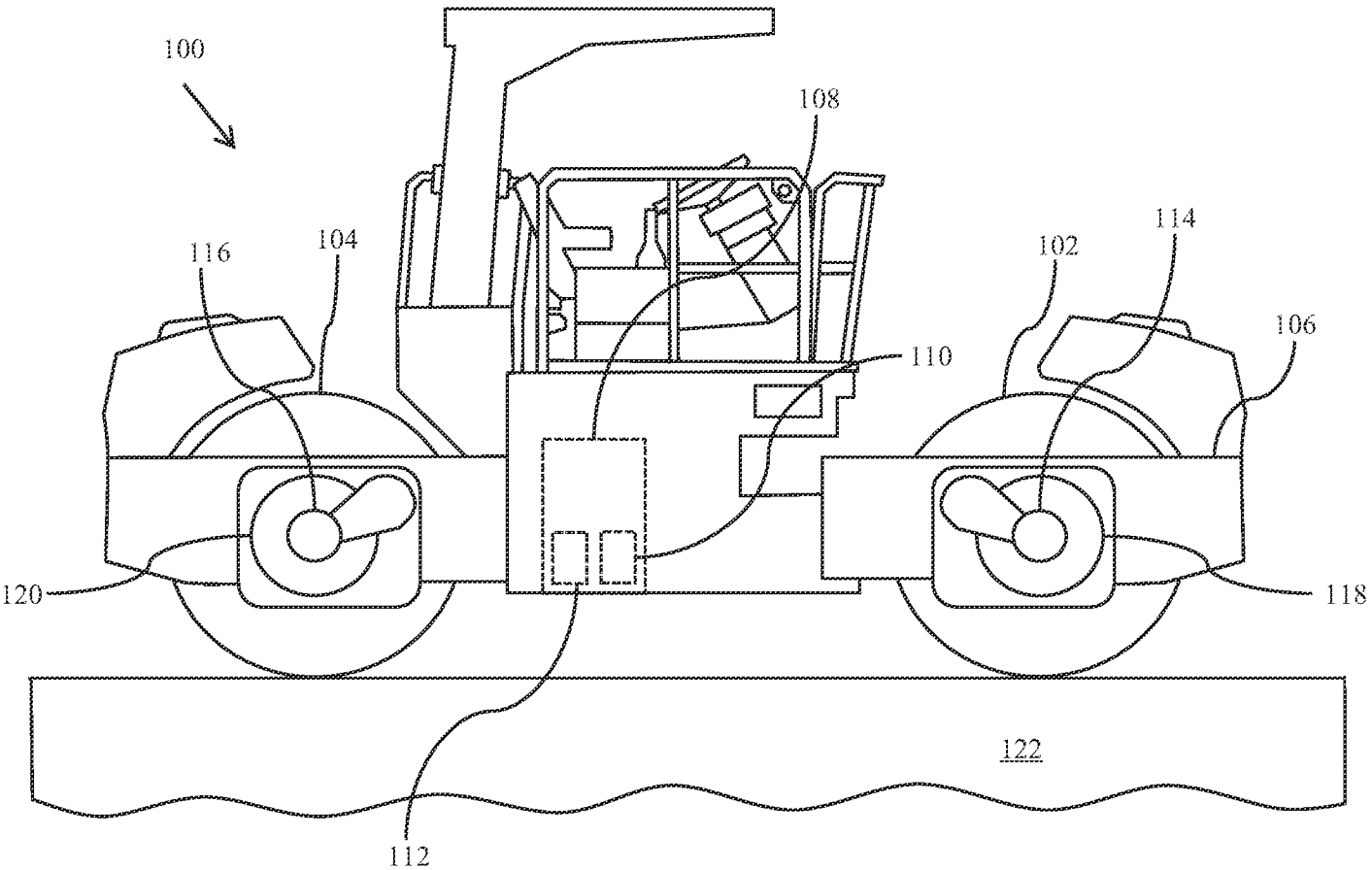
FIG. 1 is a side view of a vibratory compactor in accordance with an embodiment of the present disclosure.

FIG. 1 is a side view of a vibratory compactor 100 in accordance with an embodiment of the present disclosure. For example, the vibratory compactor 100 is an asphalt compactor. The vibratory compactor 100 includes at least one roller. For example, the vibratory compactor 100 includes a first roller 102, and a second roller 104. In an alternative embodiment of the present disclosure, the vibratory compactor 100 may include one roller with a vibratory mechanism. Further, in an exemplary embodiment of the present disclosure, the vibratory compactor includes a main frame 106, an engine 108, a first hydraulic pump 110, a second hydraulic pump 112, a first motor 114, a second motor 116, a first vibrating mechanism 118, and a second vibrating mechanism 120. The first roller 102 includes the first vibrating mechanism 118 and the second roller 104 includes the second vibrating mechanism 120. The first roller 102 and the second roller 104 are rotatably mounted on the main frame 106.

Further, the main frame 106 is configured to house the engine 108. The engine 108 is operatively and conventionally connected to drive the first hydraulic pump 110 and the second hydraulic pump 112. The first hydraulic pump 110 is operatively connected to the first motor 114 and the second hydraulic pump 112 is operatively connected to the second motor 116. The first motor 114 is configured to accelerate the first vibrating mechanism 118 and the second vibrating mechanism 120. The second motor 116 is configured to impart rotation to the first roller 102 and the second roller 104. The rotation of the first roller 102 and the second roller 104 drives the vibratory compactor 100 in a desired direction to compact a surface 122 below the vibratory compactor 100. The first roller 102 and the second roller 104 are structurally and functionally similar. Hence, the structural and operational description of the first roller 102 is equally applicable to the second roller 104.

Figure 2:
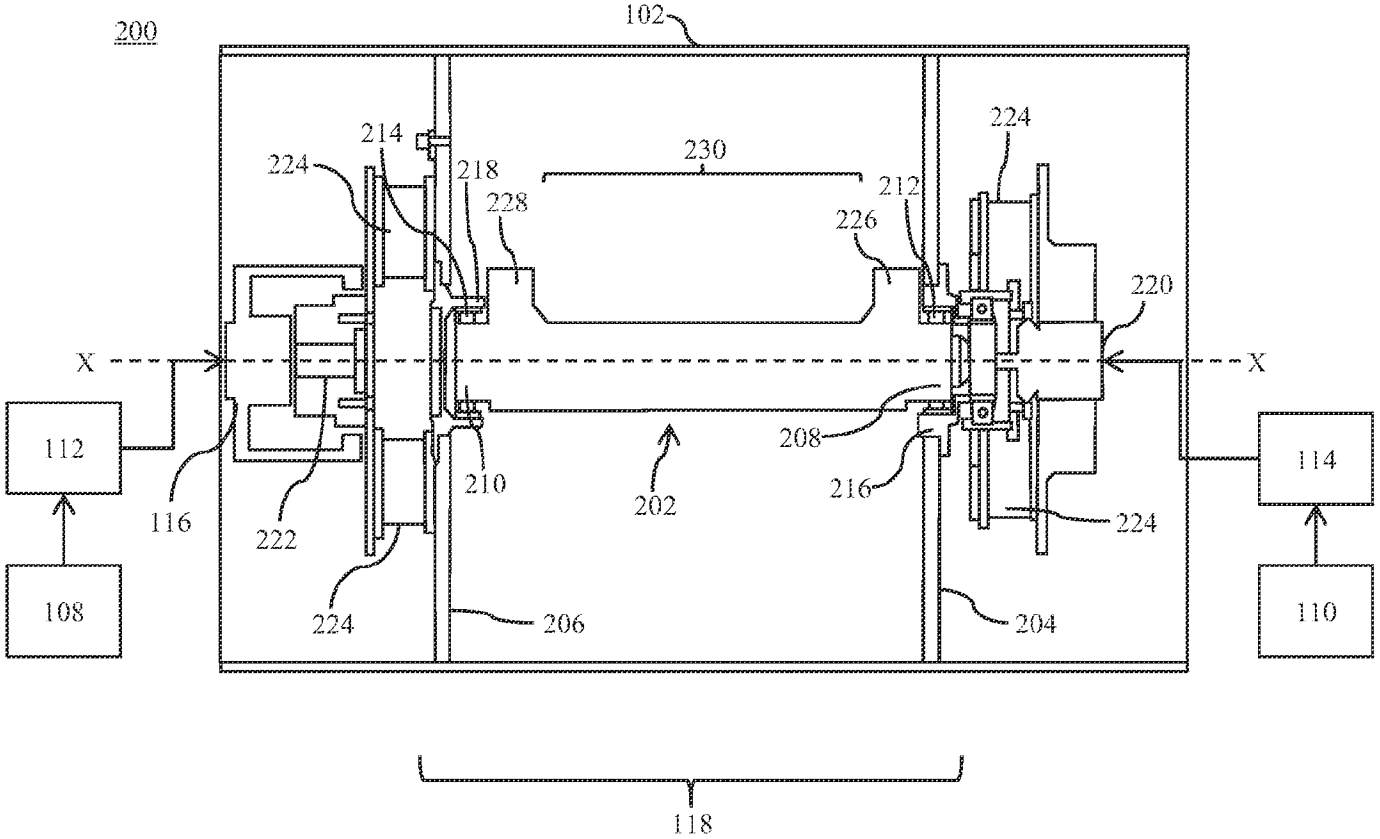
FIG. 2 is a sectional view of a roller of the vibratory compactor as illustrated in FIG. 1 in accordance with an embodiment of the present disclosure.

FIG. 2 is a sectional view 200 of the first roller 102 of the vibratory compactor as illustrated in FIG. 1 in accordance with an embodiment of the present disclosure. The first roller 102 includes the first vibrating mechanism 118. The first vibrating mechanism 118 includes an eccentric shaft 202, a first vertical support 204, and a second vertical support 206. Further, the eccentric shaft 202 consists of a first end 208 and a second end 210. The first end 208 and the second end 210 are pivoted and supported by the first vertical support 204 and the second vertical support 206, respectively. Specifically, the first end 208 and the second end 210 are positioned within a first bearing 212 and a second bearing 214, respectively. The first bearing 212 and the second bearing 214 are in turn housed inside a first bracket 216 and a second bracket 218, respectively. The first bracket 216 and the second bracket 218 are attached and supported by the first vertical support 204 and the second vertical support 206, respectively. Hence, the eccentric shaft 202 can be a shaft supported by the first vertical support 204 and the second vertical support 206, at the first end 208 and the second end 210, respectively. The first end 208 of the eccentric shaft 202 may be connected to a first coupling 220. The first coupling 220 may be connected to the first motor 114. Specifically, the first coupling 220 can transfer the rotational motion of the motor to the eccentric shaft 202. Further, the second motor 116 is coupled with the first roller 102, through a second coupling 222. In other words, the first motor 116 is coupled to the first roller in manner so as to rotate the first roller 102. It can be contemplated that a motor similar to the first motor 114 and the second motor 116 can be provided in the second roller 104.

The eccentric shaft 202 further includes a first eccentric weight 226, a second eccentric weight 228, and a center portion 230. The first eccentric weight 226 and the second eccentric weight 228 may be mounted on the eccentric shaft 202 at an equal distance from the center of the eccentric shaft 202. In other words, the first eccentric weight 226 and the second eccentric weight 228 may be located proximal to the first end 208 and the second end 210. Hence, the first eccentric weight 226 and the second eccentric weight 228 increase asymmetric mass of the shaft. Specifically, the eccentric weights 226 and 228 protrude out from the eccentric shaft 202 and thereby increase the asymmetric mass which is offset from the axis X-X of eccentric shaft 202. Hence, the rotation of asymmetric offset mass results in net centrifugal force, when the eccentric shaft 202 is rotated.

In operation, the first hydraulic pump 110 supplies pressurized fluid to the first motor 114. The first motor 114 is configured to rotate the eccentric shaft 202 through the coupling at the first end 208. Subsequently, rotation of the eccentric shaft 202 is initiated as torque is applied at first end 208 by the motor 114. As the eccentric shaft 202 is rotated a centrifugal force is generated. The centrifugal force is generated because of the first eccentric weight 226 and the second eccentric weight 228. The first eccentric weight 226 and the second eccentric weight 228 increases asymmetric mass of the shaft, hence, a net centrifugal force is generated. At a certain rotational velocity, the eccentric shaft 202 attains an operating frequency and starts to vibrate due to net centrifugal force. Vibration of the eccentric shaft 202 induces a vibratory force on the first roller 102 through the first vertical support 204 and the second vertical support 206. Hence, with the rotation of the eccentric shaft induces vibratory forces in the first roller 102. Further, the vibration of the first roller 102 can be used to compact the surface 122 on which the vibratory compactor 100 is resting. In an embodiment a pair of rubber pads 224 may be provided to isolate the first vibrating mechanism 118 from the main frame 106.

The second hydraulic pump 112 is configured to supply pressurized hydraulic fluid to the second motor 116. The second motor 116 rotates the first roller 102. It can be contemplated that a motor similar to the first motor 114 and the second motor 116 can be provided in the vibrating mechanism 120 of the second roller 104. Subsequently, the rotation of the first roller 102 and the second roller 104 may propel the vibratory compactor 100 in a forward or backward direction, while compacting the surface 122.

Figure 3:
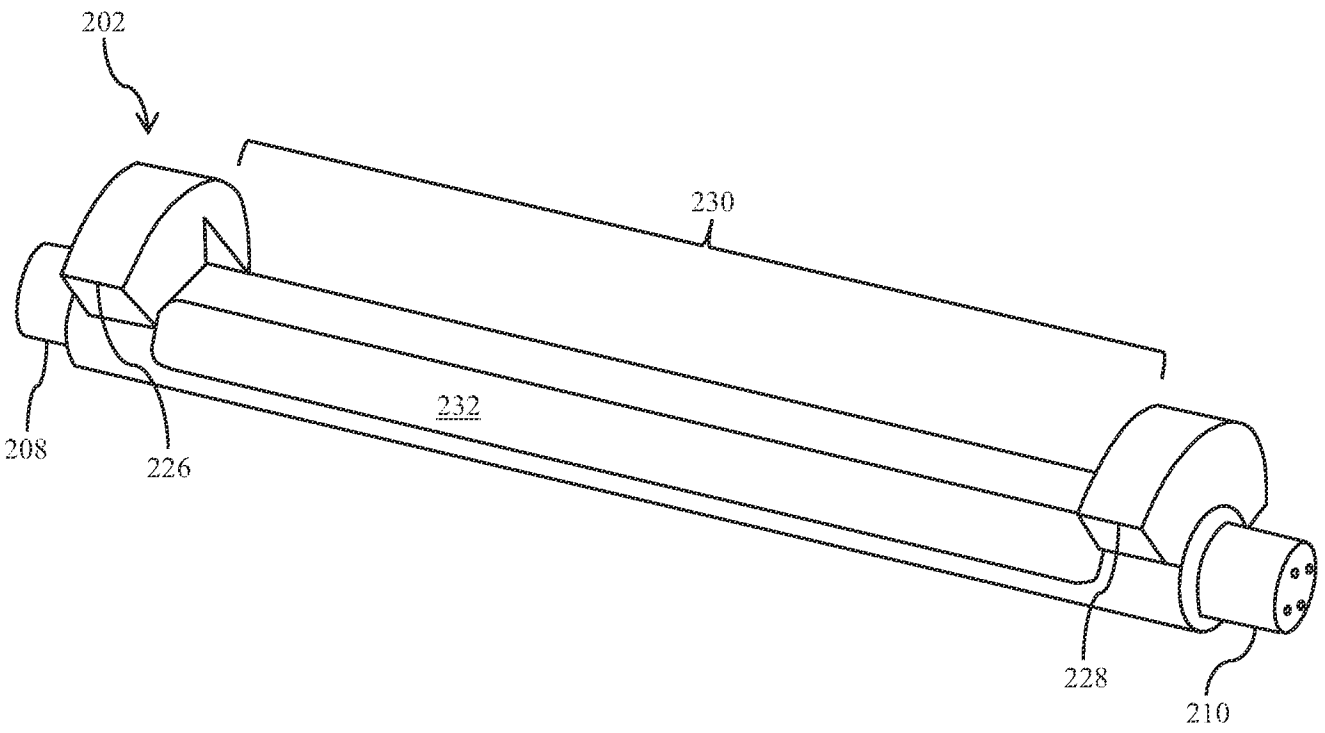
FIG. 3 is a perspective view of an eccentric shaft as shown in FIG. 2 in accordance with an embodiment of the present disclosure.

FIG. 3 is a perspective view of the eccentric shaft 202. The eccentric shaft 202 is shown to include the first end 208, the second end 210, the first eccentric weight 226, the second eccentric weight 228, and the center portion 230. Each of the first eccentric weight 226 and the second eccentric weight 228 are in shape of a segment of the eccentric shaft 202 subtending an arc of a predefined angle. The first eccentric weight 226 is disposed proximally to the first end 208. The second eccentric weight 228 is disposed proximally to the second end 210. In other words, the first eccentric weight 226 and the second eccentric weight 228 are positioned offset from the center of the eccentric shaft 202 and proximal to the first end 208 and the second end 210, respectively. The first eccentric weight 226 and the second eccentric weight 228 are positioned in a manner to asymmetrically increase the weight of the eccentric shaft 202 at the first end 208 and the second end 210. The first eccentric weight 226 and the second eccentric weight 228 are in a shape of a segment around the eccentric shaft 202 and subtending an arc of a predefined angle. Specifically, the first eccentric weight 226 and the second eccentric weight 228 are in form of thick discs mounted at the first end 208 and the second end 210. The thick discs subtend an arc of a predefined angle. Hence, the first eccentric weight 226 and the second eccentric weight 228 are in form of thick discs running around the shaft 202. In an embodiment, the thick discs may not form a complete circle around the shaft 202 but subtend an arc of the predefined angle around the eccentric shaft 202. The angle may be selected based on the size of the machine and type of compactor. The part of the eccentric shaft 202 between the first eccentric weight 226 and the second eccentric weight 228 can be referred to as the center portion 230. The center portion 230 may include a first cavity 232 on surface of the center portion 230. In an alternate embodiment a second cavity can be provided on surface of the center portion 230. Each of the first cavity 232 and the second cavity is casted along a length of the center portion 230. In an embodiment, the second cavity is casted diametrically opposite to the first cavity 232. In an embodiment of the present disclosure, each of the first cavity 232 and the second cavity may be longitudinally elongated and disposed along the length of the center portion 230, between the first eccentric weight 226 and the second eccentric weight 228. Each of the first cavity 232 and the second cavity may have a longitudinal section and with uniform width and uniform depth throughout the longitudinal section. In other words, the eccentric shaft 202 can be a shaft having two longitudinally elongated cavities opposite to each other and located at a center portion 230 and between the first eccentric weight 226 and the second eccentric weight 228.

The proposed eccentric shaft 202 may be light in weight and may require lesser start-up torque and the moment of inertia. In an exemplary embodiment of the present disclosure, the eccentric shaft 202 may be manufactured by casting the center portion 230 as an I-beam section, as shown in FIG. 3. In another embodiment, the center portion 230 can be machined. In one exemplary embodiment, the disclosed eccentric shaft 202 weighs between 15 kg and 20 kg, and may have moment of inertia in the range of 0.02836 kgm2. The start-up torque required to initiate the rotation of the eccentric shaft 202 to a rotational frequency of about 65 Hz over a 4 second start-up time period is about 2.89 Nm.

Industrial Applicability

The vibratory compactor 100 operates to compact the surface 122. The operator may actuate the vibration to the first roller 102 by using a user interface. As the operator actuates the vibration command on the user interface, a controller sends command signals to the first hydraulic pump 110. The first hydraulic pump 110 supplies pressurized hydraulic fluid to the first motor 114. The first motor 114 is actuated to accelerate the eccentric shaft 202. In other words, the eccentric shaft 202 is rotated. The eccentric shaft 202 accelerates to reach an operating frequency, for example, 65 Hz. As the eccentric shaft 202 reaches the operating frequency, the eccentric shaft 202 starts vibrating due to the first eccentric weight 226 and the second eccentric weight 228. The vibrations of the eccentric shaft 202 are induced in the first vibrating mechanism 118. The vibrations are imparted to the first roller 102 through the first vertical support 204 and the second vertical support 206 of the first vibrating mechanism 118. The vibrations in the first roller 102 compacts the surface 122 below the vibratory compactor 100.

Further, the operator actuates the second hydraulic pump 112. The second hydraulic pump 112 supplies pressurized hydraulic fluid to the second motor 116. The second motor 116 is actuated to rotate the first roller 102 and the second roller 104 in the desired direction. A rotation of the first roller 102 and the second roller 104 moves the vibratory compactor 100 in a reverse direction or a forward direction over the surface 122 to be compacted. Hence, the vibratory compactor 100 moves over the surface 122 while the first roller 102 is vibrating. Such vibration causes compacting action of the vibratory compactor 100. In one embodiment, the second roller 104 can also include a similar vibrating mechanism and the operator may choose to actuate the vibrating mechanism of the second roller 104.

In an exemplary embodiment of the present disclosure, the vibrations may be produced at the operating frequency of 65 Hz. While the eccentric shaft 202 is accelerating to reach the operating frequency of 65 Hz, the start-up time taken to attain the operating frequency of 65 Hz is about 4 seconds. The eccentric shaft 202 has a lesser moment of inertia, for example, 0.02836 kgm2. As a result of reduced moment of inertia of the eccentric shaft 202, the start-up torque is substantially lesser. A lesser start-up torque in the proposed eccentric shaft 202 implies a lesser torque is required to initiate rotation of the eccentric shaft 202. The lesser start-up torque of the eccentric shaft 202 decreases the operating costs and wear and tear of the first motor 114 and the first hydraulic pump 110 of the vibratory compactor 100. Also, the proposed design for the eccentric shaft 202 has a reduced weight as compared to the weight of the existing eccentric shaft.

It should be understood that the above description is intended for illustrative purposes only and is not intended to limit the scope of the present disclosure in any way. Thus, those skilled in the art will appreciate that other aspects of the disclosure can be obtained from a study of the drawings, the disclosure, and the appended claim.

What is claimed is:

1. A vibratory compactor comprising:

a roller rotatably mounted on a main frame and comprises a first vertical support and a second vertical support;

an eccentric shaft rotatably connected between the first vertical support and the second vertical support, the eccentric shaft comprising;

a first end and a second end;

a first eccentric weight is proximal to the first end, wherein the first eccentric weight is in a shape of a segment around the eccentric shaft subtending an arc of a predefined angle;

a second eccentric weight is proximal to the second end, wherein the second eccentric weight is in the shape of the segment around the eccentric shaft subtending the arc of the predefined angle; and a center portion between the first eccentric weight and the second eccentric weight, the center portion comprising at least one cavity on a surface of the center portion along a length of the center portion, forming a hollow section, wherein the at least one cavity is elongated between the first eccentric weight and the second eccentric weight.

* * * * *

UNITED STATES PATENT AND TRADEMARK OFFICE

CERTIFICATE OF CORRECTION

PATENT NO. : 8,967,910 B2
APPLICATION NO. : 14/160632
DATED : March 3, 2015
INVENTOR(S) : Hansen et al.

It is certified that error appears in the above-identified patent and that said Letters Patent is hereby corrected as shown below:

IN THE SPECIFICATION

Column 4, line 51, delete "Industrial Applicability" and insert -- INDUSTRIAL APPLICABILITY --.

Signed and Sealed this
Second Day of February, 2016

Michelle K. Lee

Michelle K. Lee
*Director of the United States Patent and Trademark Office*